US008050602B2

(12) United States Patent
Takai

(10) Patent No.: US 8,050,602 B2
(45) Date of Patent: Nov. 1, 2011

(54) DEVELOPING DEVICE AND IMAGE FORMING APPARATUS EQUIPPED WITH THE SAME

(75) Inventor: Takayuki Takai, Anjo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 321 days.

(21) Appl. No.: 12/417,229

(22) Filed: Apr. 2, 2009

(65) Prior Publication Data

US 2009/0317142 A1 Dec. 24, 2009

(30) Foreign Application Priority Data

Jun. 18, 2008 (JP) ..... 2008-159150

(51) Int. Cl.
*G03G 15/09* (2006.01)

(52) U.S. Cl. ..... 399/270; 399/55

(58) Field of Classification Search ..... 399/55, 399/270, 272, 273, 282, 284
See application file for complete search history.

(56) References Cited

U.S. PATENT DOCUMENTS 5,953,570 A * 9/1999 Hirai ..... 399/282
6,901,233 B2 * 5/2005 Aoki et al. ..... 399/270
7,697,873 B2 * 4/2010 Matsuura et al. ..... 399/282 X
2008/0175625 A1 * 7/2008 Goto et al. ..... 399/252
2008/0226320 A1 * 9/2008 Sakata et al. ..... 399/55
2009/0003855 A1 * 1/2009 Kubo ..... 399/55 X

FOREIGN PATENT DOCUMENTS

JP 2002-169378 6/2002
JP 2003-015380 1/2003
JP 2004-361530 12/2004
JP 2006-030456 2/2006
JP 2007-212725 8/2007

OTHER PUBLICATIONS

Notification of Reasons for Refusal issued in the corresponding Japanese Patent Application No. 2008-159150 dated Apr. 20, 2010, and an English Translation thereof.

* cited by examiner

*Primary Examiner* — Sophia S Chen
(74) *Attorney, Agent, or Firm* — Buchanan Ingersoll & Rooney, P.C.

(57) ABSTRACT

A developing device includes: a developer containing a toner and a carrier; a first transporting member placed at an opening portion of a developer vessel used for housing the developer; a second transporting member that faces the first transporting member with a first area interposed therebetween, and also faces an electrostatic latent image-supporting member with a second area interposed therebetween; a first electric-field-forming unit that forms a first electric field between the first transporting member and the second transporting member; and a second electric-field-forming unit that forms a second electric field between the second transporting member and the electrostatic latent image-supporting member. An image-forming apparatus includes the above-mentioned developing device.

14 Claims, 7 Drawing Sheets

(A)

(B)

DEVELOPING DEVICE AND IMAGE FORMING APPARATUS EQUIPPED WITH THE SAME

This application is based on application No. 2008-159150 filed in Japan, the contents of which are hereby incorporated by reference.

BACKGROUND OF THE INVENTION

1. Field of the Invention

The present invention relates to an image-forming apparatus of an electrophotographic system and a developing device used for such an image-forming apparatus.

2. Description of the Related Art

With respect to developing systems used for the image-forming apparatus of an electrophotographic system, a mono-component developing system using only toner as a main component of a developer and a two-component developing system using a toner and a carrier as main components of a developer have been known.

A developing device of the mono-component developing system is provided with a toner supporting member that supports toner thereon and transports the toner and a toner-regulating blade that is made contact with the toner supporting face of the toner supporting member. Upon passing through the contact position with the toner-regulating blade, the toner, supported on the toner supporting member, is made friction-contact with the toner-regulating blade to be formed into a thin film, and also charged to a predetermined polarity. In this manner, since the mono-component developing device carries out a toner-charging process through the friction-contact with the toner-regulating blade, the resulting advantage is that the structure is simple, small, and inexpensive. Moreover, since only the toner layer having an upper limit value of 10+several micron meters in thickness is formed on the toner supporting member, the toner supporting member and the photosensitive member can be designed with a fine gap maintained therebetween, and consequently, a high toner transporting speed can be achieved by setting a strong electric-field so that high image quality with high precision can be obtained. However, toner degradation tends to occur due to a high stress in the regulating portion, and the quantity of charge of toner tends to be lowered in endurance use. Moreover, the charge-applying property to the toner is lowered by contamination of the toner-regulating blade and the surface of the toner supporting member due to the toner and external additives to cause problems of fogging and the like, with the result that it becomes difficult to prolong the service life of the developing device.

Since the developing device of the two-component developing system charges the toner and the carrier to predetermined polarities by making them in friction-contact with each other, the stress to be applied to the toner is smaller in comparison with that of the mono-component developing device. Since the surface area of the carrier is larger in comparison with that of the toner, the carrier is less vulnerable to contamination due to adhesion of the toner. However, the length of a magnetic brush formed on a developer supporting member by the carrier is 20 to 50 times thicker than the thickness of the toner layer on the toner supporting member of the mono-component developing system, and the magnetic brush becomes uneven from the microscopic viewpoint. As a result, inevitably, a weaker electric field needs to be set in comparison with that of the mono-component developing system by taking into consideration prevention of leak or the like, and at least one portion of the magnetic brush needs to be made in contact with the photosensitive member. Consequently, since the toner transporting speed becomes slower, and since scraping off of the toner image on the photosensitive member by the carrier occurs, the image quality becomes inferior to that of the mono-component developing system.

As a developing system that adopts the advantages of the two developing systems, a hybrid developing system has been proposed in which an electric field is formed between a transporting roller (first transporting member) on which a developer charged by the two-component developing system is held and a developing roller (second transporting member), and only the toner is consequently separated to form a toner layer on the developing roller so that a mono-component developing process is carried out (Japanese Patent-Application Laid-Open No. 2003-15380). In this developing system, at an opposing portion between the developing roller and the transporting roller, only the toner is selectively supplied from the transporting roller to the developing roller, and residual toner is recovered from the developing roller to the transporting roller. This system makes it possible to achieve both of the long service life of the apparatus and high image quality. In this system, however, at the opposing portion between the developing roller and the transporting roller, the toner supplying and recovering processes become insufficient to cause a new problem in that the toner layer on the developing roller is not sufficiently reset. For this reason, an image memory occurs due to differences in the toner amounts per unit area between the new and previous toner layers on the developing roller as well as in the quantities of charge in the toner. This problem is caused by difficulty in achieving the two directly-opposed functions that, while a new toner is being supplied from the transporting roller to the developing roller, residual toner on the developing roller after the developing process has to be recovered by the developer on the transporting roller, at an area close to the transporting roller and the developing roller. In the case when the toner supply is preferentially set so as to provide high quality images, high speed and the like of the apparatus, the occurrence of image memory becomes particularly conspicuous. For example, in an attempt to meet the recent trend of high charge quantity per unit mass so as to achieve a small size of the toner and also meet demands in the market for high quality image, when the adhering strength (mirror image strength) to the developing roller is increased, or when the toner amount of supply to the developing area per unit time is increased so as to meet the demands for high speed, the recovering property is lowered, with the result that the occurrence of image memory tends to become conspicuous. In contrast, when the toner supply is insufficient, the image density consequently becomes insufficient.

The present invention is to provide a hybrid developing device and an image-forming apparatus that can produce images in which a sufficient image density is achieved and the occurrence of image memory is sufficiently prevented, for a long period.

BRIEF SUMMARY OF THE INVENTION

The present invention relates to a developing device, which visualizes an electrostatic latent image on an electrostatic latent image-supporting member by using a developer containing a toner and a carrier, and comprises:

a developer that contains a toner and a carrier so that the toner is charged to a first polarity, while the carrier is charged to a second polarity that is different from the first polarity, by mutual frictional contact between the toner and the carrier;

a first transporting member placed at an opening portion of a developer vessel used for housing the developer;

a second transporting member that faces the first transporting member with a first area interposed therebetween, and also faces an electrostatic latent image-supporting member with a second area interposed therebetween;

a first electric-field-forming unit used for forming a first electric field between the first transporting member and the second transporting member so that the toner in the developer held by the first transporting member is transferred onto the second transporting member; and a second electric-field-forming unit used for forming a second electric field between the second transporting member and the electrostatic latent image-supporting member so that the toner held by the second transporting member is transferred onto the electrostatic latent image on the electrostatic latent image-supporting member to visualize the electrostatic latent image, wherein the first electric field, formed between the first transporting member and the second transporting member, includes at least an ac electric field, and the second transporting member has a surface that is charged to the same polarity as the charged polarity of the toner by friction-contact with the carrier, and a volume resistance value of $1\times10^3$ to $1\times10^9$ (Ω), and an image-forming apparatus equipped with the developing device.

DETAILED DESCRIPTION OF THE INVENTION

Figure 1:
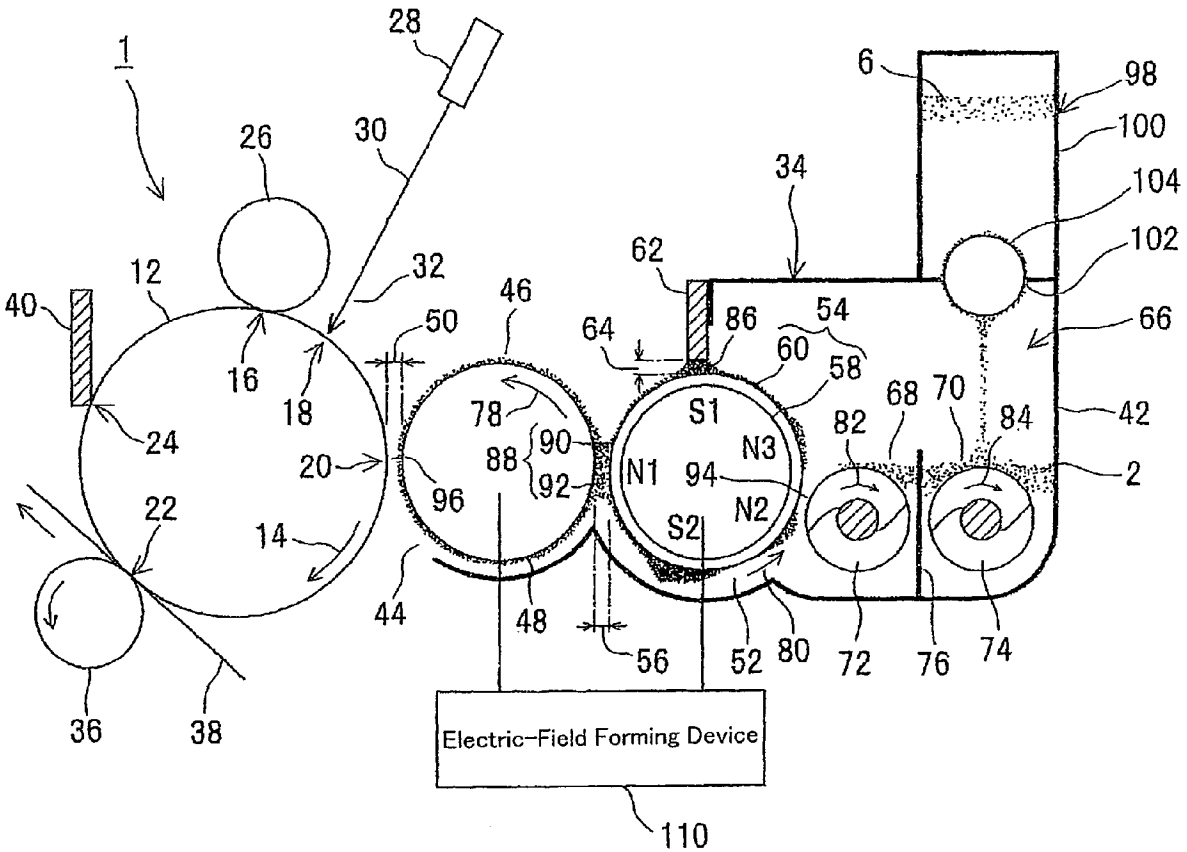
FIG. 1 is a view showing a schematic structure of one example of an image-forming apparatus in accordance with the present invention and a cross section of one example of a developing device in accordance with the present invention.

A developing device of the present invention is a developing device, which visualizes an electrostatic latent image on an electrostatic latent image-supporting member by using a developer containing a toner and a carrier, and comprises:

a developer that contains a toner and a carrier so that the toner is charged to a first polarity, while the carrier is charged to a second polarity that is different from the first polarity, by mutual frictional contact between the toner and the carrier;

a first transporting member placed at an opening portion of a developer vessel used for housing the developer;

a second transporting member that faces the first transporting member with a first area interposed therebetween, and also faces an electrostatic latent image-supporting member with a second area interposed therebetween;

a first electric-field-forming unit used for forming a first electric field between the first transporting member and the second transporting member so that the toner in the developer held by the first transporting member is transferred onto the second transporting member; and a second electric-field-forming unit used for forming a second electric field between the second transporting member and the electrostatic latent image-supporting member so that the toner held by the second transporting member is transferred onto the electrostatic latent image on the electrostatic latent image-supporting member to visualize the electrostatic latent image, wherein the first electric field, formed between the first transporting member and the second transporting member, includes at least an ac electric field, and the second transporting member has a surface that is charged to the same polarity as the charged polarity of the toner by friction-contact with the carrier, and a volume resistance value of $1\times10^3$ to $1\times10^9$ (Ω).

An image-forming apparatus of the present invention comprises the above-mentioned developing device.

In the hybrid developing device of the present invention, the second transporting member is provided with a surface that is charged to the same polarity as the toner charged polarity when the toner and the carrier are made in friction-contact with each other, due to frictional contact with the carrier, and also has a specific resistance value. With this arrangement, since the carrier to be charged to a specific polarity by the frictional contact with the toner is further effectively charged to the corresponding polarity also by the frictional contact with the surface of the second transporting member, the carrier charge quantity at the time of toner recovery is increased. At this time, a first electric field including an ac electric field is formed between the first transporting member and the second transporting member, the carrier is allowed to further effectively recover the toner by an electrostatic force at the time of toner recovery, and the carrier is allowed to supply a sufficient amount of toner at the time of toner supply. For these reasons, it is possible to provide images in which a sufficient image density is achieved and the occurrence of image memory is sufficiently prevented, for a long period. These effects are also efficiently exerted even when the image-forming apparatus is prepared as a high-speed machine, when a small-size toner is used so as to achieve high-precision images, or when the image-forming apparatus is operated under a low-moisture environment.

Referring to the attached drawings, the following description will discuss preferred embodiments of the present invention. In the following description, terms indicating specific directions (for example, "up", "down", "left" and "right" and other terms including these, as well as "clockwise" and "counterclockwise") are used; however, these terms are used only for easiness of understanding of the present invention by reference to the drawings, and the present invention is not intended to be interpreted in a limited manner by the meanings of these terms. In the image forming apparatus and the developing device described below, the same or similar components are indicated by the same reference numerals.

Image Forming Apparatus

FIG. 1 shows components relating to image-forming processes of an electrophotographic image-forming apparatus in accordance with the present invention. The image-forming apparatus may be any one of a copying machine, a printer, a facsimile and a composite machine provided with these functions in a composite manner. This image-forming apparatus 1 is provided with a photosensitive member 12 serving as an electrostatic latent image-supporting member. In this embodiment, the photosensitive member 12 is made of a cylindrical member; however, the present invention is not limited to this mode, and instead of this, a photosensitive member of an endless belt type may also be used. The photosensitive member 12 is coupled to a motor, not shown, to be driven thereby, and allowed to rotate in a direction indicated by arrow 14 when driven by the motor. On the periphery of the photosensitive member 12, a charging station 16, an exposing station 18, a developing station 20, a transferring station 22 and a cleaning station 24 are disposed, along the rotation direction of the photosensitive member 12.

The charging station 16 is provided with a charging device 26 that charges a photosensitive layer forming the outer circumferential face of the photosensitive member 12 to a predetermined electric potential. In the present embodiment, the charging device 26 is shown as a roller having a cylindrical shape; however, instead of this, a charging device of another mode (for example, a brush-type charging device of a rotation type or a fixed type, or a wire discharging-type charging device) may be used. The exposing station 18 is provided with a passage 32 that allows imaging light 30, emitted from an exposing device 28 placed near the photosensitive member 12 or at a position apart from the photosensitive member 12, to proceed toward the outer circumferential face of the charged photosensitive member 12. On the outer circumferential face of the photosensitive member 12 that has passed through the exposing station 18, an electrostatic latent image, which is made of portions where the electric potential has been decayed by the imaging light projected thereto and portions where the charged electric potential has been virtually maintained, is formed. In the present embodiment, the portions having the decayed electric potential correspond to an electrostatic latent image portion, and the portions that virtually maintain the charged electric potential correspond to an electrostatic latent image non-image portion. The developing station 20 has a developing device 34 that visualizes the electrostatic latent image by using a powder developer. The developing device 34 will be described later in detail. The transferring station 22 is provided with a transferring device 36 that transfers the visible image formed on the outer circumferential face of the photosensitive member 12 onto a sheet 38 such as paper and a film. In the present embodiment, the transferring member 36 is shown as a roller having a cylindrical shape; however, a transferring device of another mode (for example, wire discharging-type transferring device) may be used. The cleaning station 24 is provided with a cleaning device 40 that recovers untransferred toner remaining on the outer circumferential face of the photosensitive member 12, without having been transferred onto the sheet 38 in the transferring station 22, from the outer circumferential face of the photosensitive member 12. In the present embodiment, the cleaning device 40 is shown as a plate-shaped blade; however, instead of this, a cleaning device of another mode (for example, a rotation-type or fixed brush-type cleaning device) may be used.

Upon forming an image by using the image-forming device 1 with this structure, the photosensitive member 12 rotates clockwise by the driving operation of the motor (not shown). At this time, the outer circumferential portion of the photosensitive member that has passed through the charging station 16 is charged by the charging device 26 to a predetermined electric potential. The charged outer circumferential portion of the photosensitive member is exposed by the imaging light 30 in the exposing station 18 so that an electrostatic latent image is formed. The electrostatic latent image is transported to the developing station 20 together with the rotation of the photosensitive member 12, and visualized therein by the developing device 34 as a developer image. The developer image thus visualized is transported to the transferring station 22 together with the rotation of the photosensitive member 12, and then transferred onto a sheet 38 by the transferring device 36. The sheet 38 on which the developer image has been transferred, is transported to a fixing station, not shown, where the developer image is fixed onto sheet 38. The outer circumferential portion of the photosensitive member that has passed through the transferring station 22 is then transported to the cleaning station 24 where the developer that remains on the outer circumferential face of the photosensitive member 12 without being transferred onto the sheet 38 is recovered.

Developing Device

The developing device 34 is provided with a developing vessel (housing) 42 that houses a two-component developing agent 2 containing a toner and a carrier as well as various members, which will be described below. For easiness of understanding of the present invention, one portion of the developing vessel 42 is omitted so as to simplify the drawings. The developing vessel 42 is provided with a series of opening portions (44, 52) that are opened toward the photosensitive member 12, and a developing roller 48 serving as a toner transporting member (second transporting member) is placed in a space 46 formed near the opening portion 44. This developing roller 48, which is a cylindrical member (second rotation cylindrical member), is rotatably placed in parallel with the photosensitive member 12, with a predetermined developing gap 50 interposed relative to the outer circumferential face of the photosensitive member 12.

In the present invention, the developing roller 48 has a surface that is charged to the same polarity as the charged polarity of the toner upon frictional contact between the toner and the carrier, by a frictional contact with the carrier. From the viewpoint of preventing fogging due to the generation of a reversely charged toner, the developing roller 48 is preferably provided with a surface that causes hardly any exchange of charges, even when made in frictional contact with the toner. The expression that "causes hardly any exchange of charges" indicates that, at least, apparently, there is little change in the quantity of charge due to exchanges of charges.

For example, in the case when a toner to be charged to negative polarity by frictional contact with the carrier is used, the developing roller is prepared as one having a surface layer to be charged to the negative polarity by frictional contact with the carrier, and such a roller that has a surface layer that causes hardly any exchange of charges upon frictional contact with the toner is used as a desirable developing roller. Examples of such a negatively chargeable surface layer include a negatively chargeable organic layer made of a fluorine-containing resin and a negatively chargeable inorganic layer made of silicon fluoride glass. Not particularly limited as long as it is a polymer containing fluorine atoms, examples of the fluorine-containing resin include a fluorine-containing olefin resin, a fluorine-containing acrylic resin and the like.

Specific examples of the fluorine-containing olefin resin include polytetrafluoroethylene (PTFE), polyvinylidene fluoride and the like. Polytetrafluoroethylene is available as PTFE851-212 made by DuPont Corp.

Specific examples of the fluorine-containing acrylic resin include polymethacrylate fluoride and the like.

The negatively chargeable organic layer may contain a negative-charge controlling agent that is charged to the negative polarity when made in contact with the carrier. A negative-charge controlling agent, which will be exemplified in the following description of charged-particles, may be used. When the negative-charge controlling agent is contained in the negatively chargeable organic layer, the constituent resin of the organic layer is not limited by the above-mentioned fluorine-containing resin or the like, and another resin, such as polyester, epoxy resin and styrene-methacrylate ester copolymer, may be used.

From the viewpoint of easiness of production, the negatively chargeable surface layer is preferably prepared as an organic layer, and from the viewpoint of effectively suppressing the consumption of the charged-particles, an organic layer made from a fluorine-containing silicone resin, in particular, made of PTFE, is preferably used.

Preferable combinations of a resin forming the negatively chargeable surface layer, a resin forming the carrier (positively chargeable) and a binder resin forming the negatively chargeable toner are described as follows:

(Negatively chargeable surface layer-Carrier-Negatively chargeable toner)

(Fluorine Resin-Acrylic Resin-Styrene Acrylic Resin)

(Polymeric polyethylene resin-Acrylic resin-Styrene acrylic resin)

(Fluorine Resin-Silicone Resin-Styrene Acrylic Resin)

For example, in the case when a toner that is positively charged when made in frictional contact with the carrier is used, the developing roller is prepared as one having a surface layer to be charged to the positive polarity by frictional contact with the carrier, and such a roller that has a surface layer that causes hardly any exchange of charges upon frictional contact with the toner is used as a desirable developing roller. Examples of such a positively chargeable surface layer include a positively chargeable organic layer made of a nitrogen-containing resin and a positively chargeable inorganic layer made of strontium titanate, barium titanate and alumina. Not particularly limited as long as it is a polymer containing nitrogen atoms, examples of the nitrogen-containing resin include a nitrogen-containing silicone resin, a nitrogen-containing acrylic resin, polyimide, polyamide and the like.

Specific examples of the nitrogen-containing silicone resin include amino-modified silicone resins indicated by the following formula (I):

(I)

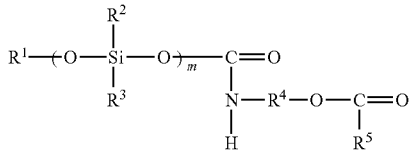

In formula (I), $R^1$ to $R^3$ independently represent alkyl groups having 1 to 5 carbon atoms, preferably methyl groups at the same time. Specific examples of the preferable alkyl groups include: a methyl group, an ethyl group, an isopropyl group and an n-propyl group.

$R^4$ represents an alkylene group having 1 to 3 carbon atoms, preferably an ethylene group.

$R^5$ represents an alkyl group having 1 to 3 carbon atoms. Specific examples of preferable alkyl groups include a methyl group, an ethyl group, an isopropyl group and an n-propyl group.

Specific examples of the nitrogen-containing acrylic resin include homopolymers or copolymers that are made of one kind or two or more kinds of nitrogen-containing monomers, selected from the group consisting of polyaminoacrylate resins, indicated by the following formula (II), (II)

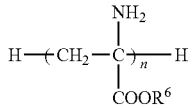

as well as 2-dimethylaminoethyl acrylate, 2-diethylaminoethyl acrylate, 2-dimethylaminoethyl methacrylate, 2-diethylaminoethyl methacrylate, vinyl pyridine, N-vinyl carbazole and vinyl imidazole.

In formula (II), $R^6$ represents an alkyl group having 1 to 8 carbon atoms, preferably 1 to 5 carbon atoms. Specific examples of the preferable alkyl group include such as a methyl group, an ethyl group, a propyl group and a butyl group.

The character n is an integer of 40 to 180.

The positively chargeable organic layer may contain a positive-charge controlling agent that is charged to the positive polarity when made in contact with the toner. A positive-charge controlling agent, which will be exemplified in the following description of charged-particles may be used. When the positive-charge controlling agent is contained in the positively chargeable organic layer, the constituent resin of the organic layer is not limited by the above-mentioned nitrogen-containing resin or the like, and another resin, such as styrene-methacrylate copolymer and epoxy resin, may be used.

From the viewpoint of easiness of production, the positively chargeable surface layer is preferably prepared as an organic layer, and from the viewpoint of effectively suppressing the consumption of the charged-particles, an organic layer, made of a nitrogen-containing silicone resin, a nitrogen-containing acrylic resin, or polyimide, in particular, an organic layer, made of an amino-modified silicone resin indicated by the above-mentioned formula (I), a polyamino acrylate resin indicated by the above-mentioned formula (II), or polyimide, is preferably used.

Preferable combinations of a resin forming the positively chargeable surface layer, a resin forming the carrier (negatively chargeable) and a binder resin forming the positively chargeable toner are described as follows:

(Positively chargeable surface layer-Carrier-Positively chargeable toner)

(Polyamide Resin-Acrylic Resin-Styrene Acrylic Resin)

The organic layer can be produced by processes in which a predetermined resin is dissolved in a solvent and the solution is applied onto the surface of a predetermined aluminum pipe or stainless (SUS) pipe to be dried thereon. When a resin such as PTFE that hardly dissolves in a solvent is used, the resin in an emulsion state may be used, and after the coating process, the resulting layer is baked so that the organic layer is produced.

The inorganic layer can be produced by using a predetermined inorganic substance and by carrying out a vapor deposition method or the like thereon.

The developing roller 48 has a volume resistance value of $1\times10^3$ to $1\times10^9$ (Ω), preferably $5\times10^3$ to $5\times10^8$ (Ω). When the resistance value is too low, the quantity of charge (quantity of transferred charge) becomes smaller upon allowing the carrier to charge through friction between the developing roller 48 and the carrier, with the result that the recovery of toner on the developing roller 48 after a developing process becomes insufficient to cause an image memory. When the resistance value is too high, the effective value of a toner supplying electric field to be formed between the developing roller 48 and the developer transporting member is lowered due to an increase in the quantity of surface charge of the developing roller 48 caused by friction between the developing roller 48 and the carrier, with the result that an insufficient quantity of transported toner onto the developing roller 48 occurs upon carrying out endurance printing processes, and the image density is consequently lowered.

The resistance value of the developing roller can be found by using a HIRESTA® made by Mitsubishi Chemical Corp., so that volume resistance measurements between the metal shaft portion of the developing roller and the electrode made in contact with the surface layer are carried out. In this case, however, the measuring device is not particularly limited by this, as long as the same principle is applied.

Although not particularly limited as long as the object of the present invention can be achieved, the thickness of the surface layer possessed by the developing roller 48 is preferably set in a range from 10 to 50 μm, from the viewpoints of ensuring the memory erasing effect during the service life of the developing device and of more effectively preventing a reduction of image density.

Another space 52 serving as an opening portion is formed behind the developing roller 48. In this space 52, a transporting roller 54 serving as a developer transporting member (first transporting member) is disposed in parallel with the developing roller 48, with a predetermined supply/recovery gap 56 being interposed between it and the outer circumferential face of the developing roller 48. The transporting roller 54 is provided with a magnet member 58 secured thereto so as not to rotate, and a cylindrical sleeve 60 (first rotation cylindrical member) supported so as to rotate around the periphery of the magnet member 58. Above the sleeve 60, a regulating blade 62, which is fixed to the developer vessel 42, and extends in parallel with the center axis of the sleeve 60, is placed face to face therewith, with a predetermined regulating gap 64 interposed therebetween.

The magnet member 58 has a plurality of magnetic poles that are aligned face to face with the inner face of the transporting roller 54, and extended in the center axis direction of the transporting roller 54. In the present embodiment, the magnetic poles include a magnetic pole S1 that faces the upper inner circumferential portion of the transporting roller 54 located near the regulating blade 62, a magnetic pole N1 that faces the inner circumferential portion on the left side of the transporting roller 54 located near the supply/recover gap 56, a magnetic pole S2 that faces the lower inner circumferential portion of the transporting roller 54, and two adjacent magnetic poles N2 and N3 having the same polarity that face the inner circumferential portion on the right side of the transporting roller 54.

A developer stirring chamber 66 is formed behind the transporting roller 54. The stirring chamber 66 is provided with a front chamber 68 formed near the transporting roller 54 and a rear chamber 70 apart from the transporting roller 54. A front screw 72, which serves as a front stirring transport member that transports the developer from the surface of the drawing toward the rear face thereof while stirring the developer, is placed in the front chamber 68 so as to rotate therein, and a rear screw 74, which serves as a rear stirring transport member that transports the developer from the rear face of the drawing toward the surface thereof while stirring the developer, is placed in the rear chamber 70 so as to rotate therein. As shown in the Figure, the front chamber 68 and the rear chamber 70 may be separated by a partition wall 76 placed between the two chambers. In this case, a partition wall portion located near the two ends of the front chamber 68 and the rear chamber 70 is removed to form a communication passage so that the developer that has reached the end portion on the downstream side of the front chamber 68 is sent to the rear chamber 70 through the communication passage, while the developer that has reached the end portion on the downstream side of the rear chamber 70 is sent to the front chamber 68 through the communication passage.

The following description will discuss operations of the developing device 34 structured as described above. Upon forming an image, the developing roller 48 and the sleeve 60, driven by motors not shown, are allowed to rotate respectively in directions of arrows 78 and 80. The front screw 72 rotates in a direction of arrow 82, while the rear screw 74 rotates in a direction of arrow 84. Consequently, the developer 2, housed in the developer stirring chamber 66, is stirred, while being transported and circulated between the front chamber 68 and the rear chamber 70. As a result, the toner and carrier contained in the developer are made friction-contact with each other to be charged to respectively reversed polarities. In the present embodiment, it is defined that the carrier is charged to the positive polarity and that the toner is charged to the negative polarity. Since the carrier particle is considerably large in comparison with the toner particle, the toner particles negatively charged are allowed to adhere to the periphery of each of the carrier particles positively charged, mainly through an electrical suction force exerted between the two particles.

Figure 2:
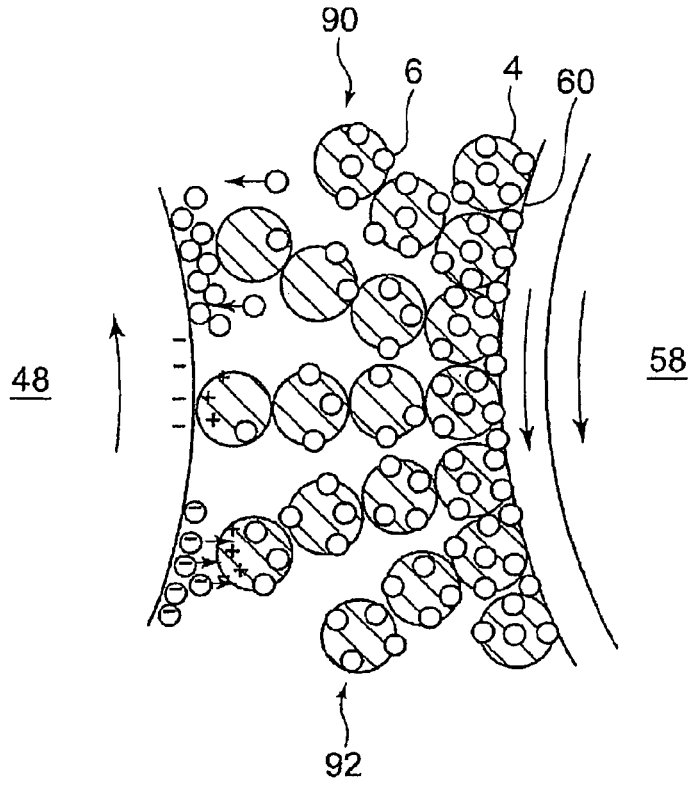
FIG. 2 is a schematic view for illustrating the functions and effects of the present invention.

The developer 2, thus charged, is supplied to the transporting roller 54, while being transported through the front chamber 68 by the front screw 72. The developer 2, supplied onto the transporting roller 54 from the screw 72, is held onto the outer circumferential face of the sleeve 60 near the magnetic pole N3 by the magnetic force of the magnetic pole N3. The developer 2, held on the sleeve 60, forms a magnetic brush along lines of magnetic forces formed by the magnet member 58, and is transported counterclockwise due to the rotation of the sleeve 60. The developer 2, held by the magnetic pole S1 on an opposing area (regulating area 86) to the regulating blade 62, is regulated by the regulating blade 62 so that the amount thereof to be allowed to pass through the regulating gap 64 is regulated to a predetermined amount. The developer 2 that has passed through the regulating gap 64 is transported to an area (supply/recover area) 88 opposing to the magnetic pole N1, where the developing roller 48 and the transporting roller 54 are made face to face with each other. Mainly at an area (supply area) 90 on the upstream side of the supply/recovery area 88 relative to the rotation direction of the sleeve 60, the toner adhering to the carrier is electrically supplied to the developing roller 48 due to the presence of the first electric field formed between the developing roller 48 and the sleeve 60. Mainly at an area (recovery area) 92 on the down stream side of the supply/recovery area 88 relative to the rotation direction of the sleeve 60, toner on the developing roller 48 that has not been consumed by the developing and has been returned to the supply/recovery area 88 is scraped by the magnetic brush formed along the lines of magnetic forces of the magnetic pole N1, and recovered by the sleeve 60. FIG. 2 is an enlarged schematic view showing the supply area 90 and the recovery area 92 in FIG. 1. More specifically, as shown in FIG. 2, the carrier 4 is held on the outer circumferential face of the sleeve 60 by a magnetic force of the magnet member 58, and is transported to the supply area 90 by the rotation movement of the sleeve 60, with the toner 6 being held thereon, so that the toner 6 is supplied to the developing roller 48 by a first electric field, which will be described later, in detail. Thereafter, the carrier 4 is charged to the reversed polarity to the toner charged polarity on the developing roller 48, by a frictional contact with the developing roller 48 having the above-mentioned surface so that, by a Coulomb force exerted between the toner charge and the carrier charge, the separation of the toner from the developing roller 48 is accelerated and the residual toner is sufficiently recovered in the recovery area 92 by the first electric field. The carrier, which is held onto the outer circumferential face of the sleeve 60 by the magnetic force of the magnet member 58, is not transferred to the developing roller 48 from the sleeve 60. The developer 2, which has passed through the supply/recovery area 88, is held by the magnetic force of the magnet member 58 so that, when having reached the opposing area (releasing area 94) between the magnetic poles N2 and N3 after having passed through the opposing portion to the magnetic pole S2 along with the rotation of the sleeve 60, the developer 2 is released from the outer circumferential face of the sleeve 60 toward the front chamber 68 by its own gravity, at an area with no magnetic force being exerted between N2 and N3, and mixed with the developer 2 that is being transported through the front chamber 68.

The toner 6, held by the developing roller 48 at the supply area 90, is transported counterclockwise along with the rotation of the developing roller 48 so that, at an area (developing area) 96 where the photosensitive member 12 and the developing roller 48 are made face to face with each other, the toner 6 is allowed to adhere to an electrostatic latent image portion formed on the outer circumferential face of the photosensitive member 12. In an image-forming apparatus of the present embodiment, a predetermined electric potential $V_H$ of the negative polarity is applied to the outer circumferential face of the photosensitive member 12 at the charging device 26, and by means of the exposing device 28, the electrostatic latent image portion to which imaging light 30 has been projected is decayed to a predetermined electric potential $V_L$, while the electrostatic latent image non-image portion to which no imaging light 30 has been projected by the exposing device 28 is allowed to maintain virtually the charged electric potential $V_H$. Therefore, in the developing area 96, the toner 6 charged to the negative polarity is allowed to adhere to the electrostatic latent image portion by a function of an electric field formed between the photosensitive member 12 and the developing roller 48, so that this electrostatic latent image is visualized as a developer image.

When the toner 6 has been consumed from the developer 2 in this manner, it is preferable to supply toner at an amount corresponding to the consumed amount to the developer 2. For this reason, the developing device 34 is provided with a means used for measuring a mixed ratio between the toner and the carrier housed in the developing vessel 42. A toner supplying unit 98 is placed above the rear chamber 70. The toner supplying unit 98 has a container 100 used for housing the toner. An opening portion 102 is formed on the bottom portion of the container 100, and a supplying roller 104 is placed on this opening portion 102. The supplying roller 104 is connected to a motor, not shown, so as to be driven, and the motor is driven based upon an output of the means for measuring the mixed ratio of the toner and carrier so that the toner is allowed to drop and supplied to the rear chamber 70. In the present invention, since the consumption of the charging particles can be sufficiently suppressed, the supply toner can be set in a manner so as to reduce the rate of the charged-particles in comparison with the rate of content of the charging particles to the toner in the developer that has been first charged.

Figure 7:
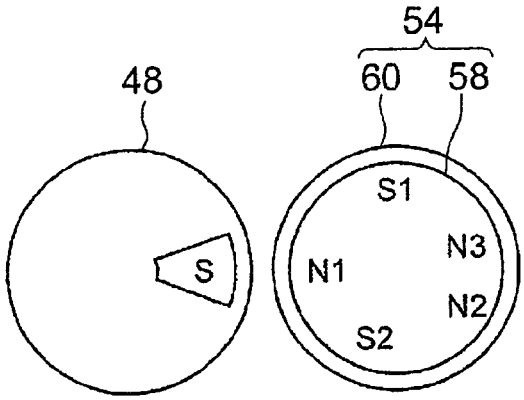
FIG. 7 is a schematic diagram showing one example of a developing roller in the developing device according to the present invention, together with the relationship thereof with the transporting roller.

In the present invention, as shown in FIG. 7, at an opposing portion to the transporting roller 54 inside the developing roller 48, a magnet, which has the magnetic pole different from the magnetic pole placed at an opposing portion to the developing roller 48 inside the transporting roller 54, is desirably placed. With this arrangement, after the toner supply at the supply area 90, the carrier is effectively made in friction-contact with the surface of the developing roller 48 so that residual toner can be more effectively recovered in the recovery area 92. In FIG. 7, the magnetic pole to be placed at the opposing portion to the developing roller 48 inside the transporting roller 54 is the N pole, and the magnetic pole to be placed at the opposing portion to the transporting roller 54 inside the developing roller 48 is the S pole; however, not limited to this structure, when the magnetic pole to be placed at the opposing portion to the developing roller 48 inside the transporting roller 54 is the S pole, the magnetic pole to be placed at the opposing portion to the transporting roller 54 inside the developing roller 48 is set to the N pole.

Electric-Field Forming Unit

In order to efficiently transfer the toner 6 from the transporting roller 54 to the developing roller 48 in the supply area 90 and also to efficiently transfer the toner 6 from the developing roller 48 to the transporting roller 54 in the recovery area 92, a first electric field is formed between the developing roller 48 and the transporting roller 54 by the first power supply for the developing roller and the second power supply for the transporting roller that serve as a first electric-field-forming unit 110.

Figure 3:
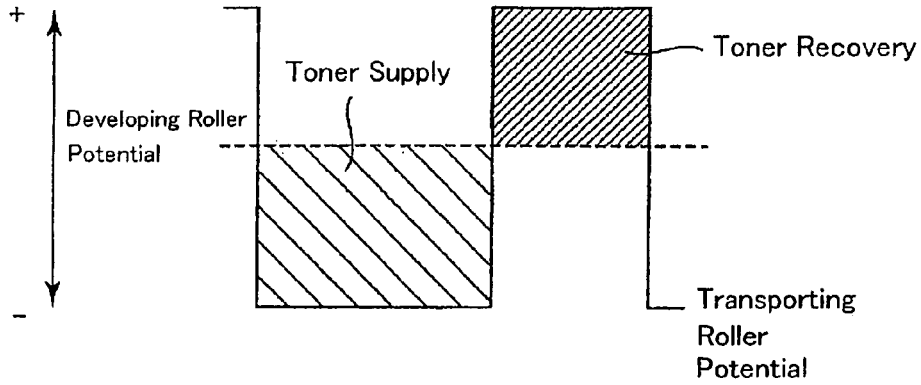
FIG. 3 is a schematic view showing one example of a first electric field that is adopted in the developing device of the present invention.

The first electric field includes at least an ac electric field, and is normally prepared as a composite electric field composed of an ac electric field and a dc electric field. That the first electric field includes an ac electric field means that, for example, supposing that the electric potential of the transporting roller is represented based upon the electric potential of the developing roller, the electric potential of the transporting roller is indicated as having an amplitude, as shown in FIG. 3. FIG. 3 shows the transporting roller electric potential when a negatively chargeable toner is used, and when the transporting roller electric potential is lower than the developing roller electric potential, the toner supply is preferentially exerted, while, when the transporting roller electric potential is higher than the developing roller electric potential, the toner recovery is preferentially exerted. By forming the first electric field between the developing roller and the transporting roller, it becomes possible to simultaneously achieve the improvement of the image density and the prevention of image memory. When the first electric field is made only of a dc electric field, only one of the toner supply and the toner recovery occurs preferentially, with the result that it is not possible to achieve both of the improvement of the image density and the prevention of image memory.

Although not particularly limited as long as the object of the present invention is achieved, the ac electric field conditions of the first electric field are preferably set to, for example, 2 to 9 kHz, in particular 2 to 4 kHz in frequency, 1000 to 3000 volts, in particular 1300 to 2500 volts in amplitude, and 50 to 70%, in particular 55 to 65% in toner supply duty ratio.

With respect to the dc electric field conditions of the first electric field, although not particularly limited as long as the toner transfer from the transporting roller to the developing roller is achieved, the electric potential difference between the developing roller and the transporting roller is preferably set to, for example, 0 to −200 volts, in particular −50 to −150 volts. The distance between the developing roller and the transporting roller is normally set to 0.2 to 0.5 mm, preferably to 0.3 to 0.4 mm.

In order to efficiently transfer the toner 6 from the developing roller 48 onto the electrostatic latent image on the photosensitive member 12 in the developing area 96 so as to visualize the electrostatic latent image, a second electric field is formed between the developing roller 48 and the photosensitive member 12 by using a first power supply for a developing roller, which serves as a second electric-field-forming unit.

The second electric field includes at least a dc electric field, and may be prepared as a composite electric field composed of an ac electric field and a dc electric field on demand. The fact that the second electric field includes an ac electric field is interpreted in the same manner as the fact that the first electric field includes an ac electric field, and means that, for example, supposing that the electric potential of the developing roller is represented based upon the electric potential of the electrostatic latent image portion of the photosensitive member, the electric potential of the developing roller is indicated as having an amplitude.

With respect to the dc electric field conditions of the second electric field, although not particularly limited as long as the toner transfer from the developing roller to the electrostatic latent image of the photosensitive member is achieved, the electric potential difference between the developing roller and the electrostatic latent image portion of the photosensitive member is preferably set to, for example, −200 to −500 volts, in particular to −250 to −400 volts. The distance between the developing roller and the photosensitive member is normally set to 0.1 to 0.2 mm, preferably to 0.1 to 0.15 mm.

With respect to the ac electric field conditions of the second electric field, although not particularly limited, for example, preferably, the frequency is set to 2 to 9 kHz, the amplitude is set to 1000 to 2000 volts, and the minus duty ratio is set to 35 to 45%.

Specific examples of the electric-field forming unit used for forming the first electric field and the second electric field include power supplies as shown in FIG. 4A to FIG. 6.

Figure 4A:
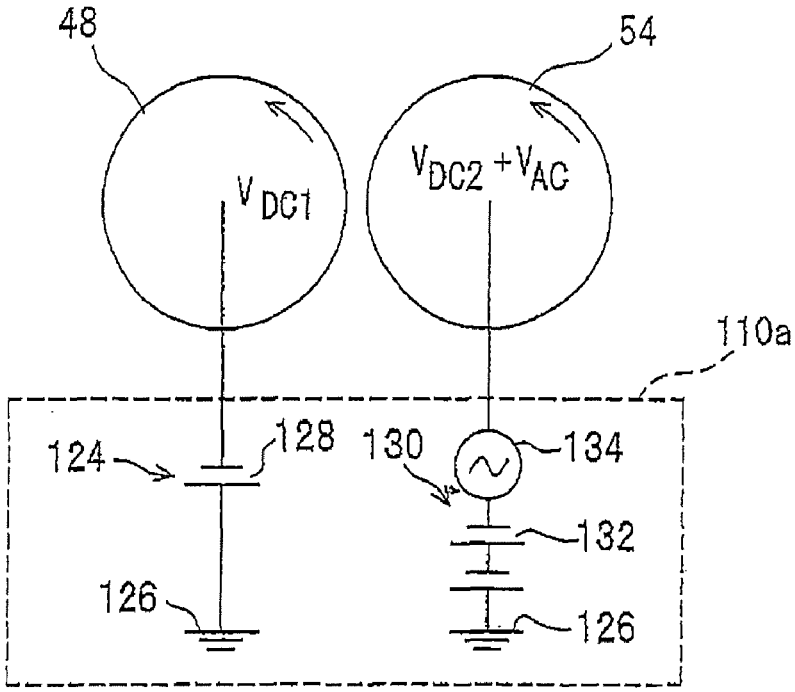
FIG. 4A is a diagram showing one embodiment of an electric-field-forming device.
Figure 4B:
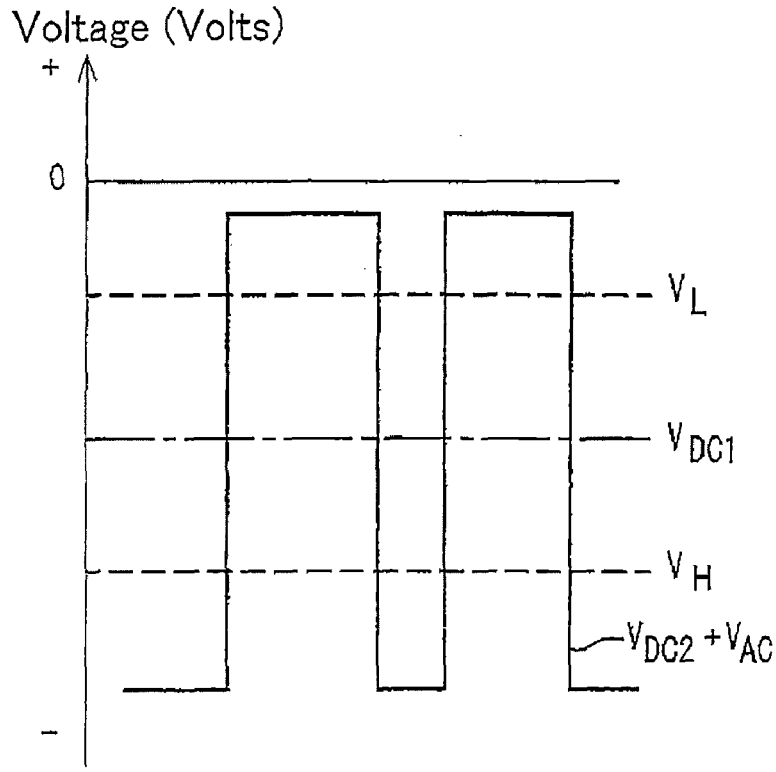
FIG. 4B is a diagram showing a relationship between voltages that are supplied to a developing roller and a transporting roller from the electric-field-forming device shown in FIG. 4A.

An electric-field forming device 110*a* of FIG. 4A is provided with a first power supply 124 connected to the developing roller 48 and a second power supply 130 connected to the transporting roller 54. The first power supply 124 has a dc power supply 128 connected between the developing roller 48 and the ground 126 so that a first dc voltage $V_{DC1}$ (for example, −200 volts) having the same polarity as the charged polarity of the toner 6 is applied to the developing roller 48. The second power supply 130 is provided with a dc power supply 132 and an ac power supply 134 between the transporting roller 54 and the ground 126. The dc power supply 132 applies a second dc voltage $V_{DC2}$ (for example, −400 volts) having the same polarity as the charged polarity of the toner 6 and a higher voltage than the first dc voltage to the transporting roller 54. As shown in FIG. 4B, the ac power supply 134 applies an ac voltage $V_{AC}$ having a peak-to-peak voltage $V_{P-P}$ of, for example, 300 volts between the transporting roller 54 and the ground 126. As a result, in the supply area 90, the toner 6, charged into the negative polarity is electrically attracted from the carrier 4 on the surface of the transporting roller 54 to the developing roller 48 by the function of a pulsating current electric field formed between the developing roller 48 and the transporting roller 54. At this time, the carrier 4, charged into the positive polarity, is held on the surface of the transporting roller 54 (sleeve 60) by a magnetic force of the fixed magnet inside the transporting roller 54, and is not supplied onto the developing roller 48. In the recovery area 92, residual toner, charged into the negative polarity is electrically attracted from the developing roller 48 onto the carrier 4 on the surface of the transporting roller 54 by the function of the pulsating current electric field formed between the developing roller 48 and the transporting roller 54. In the developing area 96, the negative polarity toner, held on the developing roller 48, is allowed to adhere to the electrostatic latent image portion based upon the electric potential difference between the developing roller 48 ($V_{DC1}$: −200 volts) and the electrostatic latent image portion ($V_L$: −80 volts).

Figure 5:
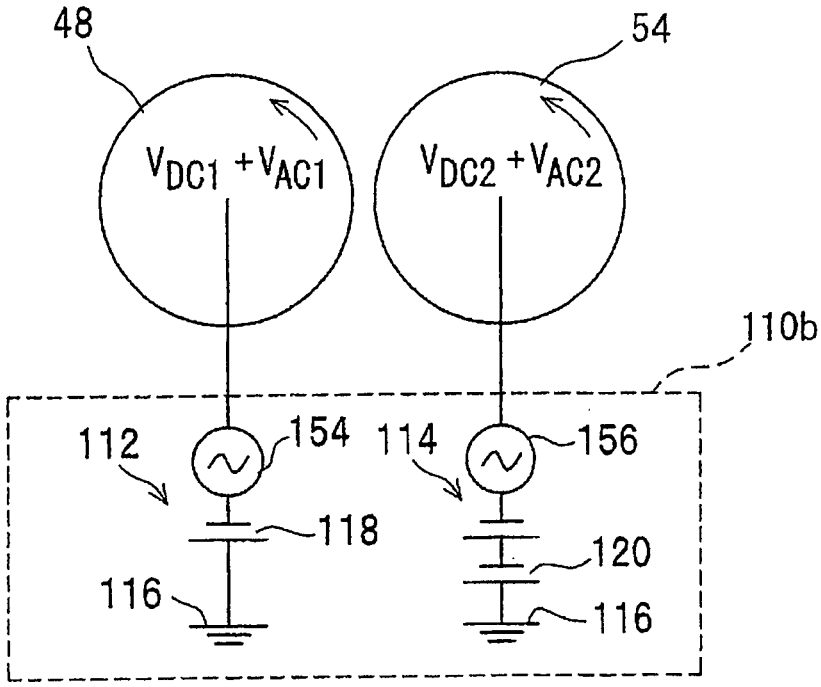
FIG. 5 is a diagram showing one embodiment of the electric-field-forming device.
Figure 11A:
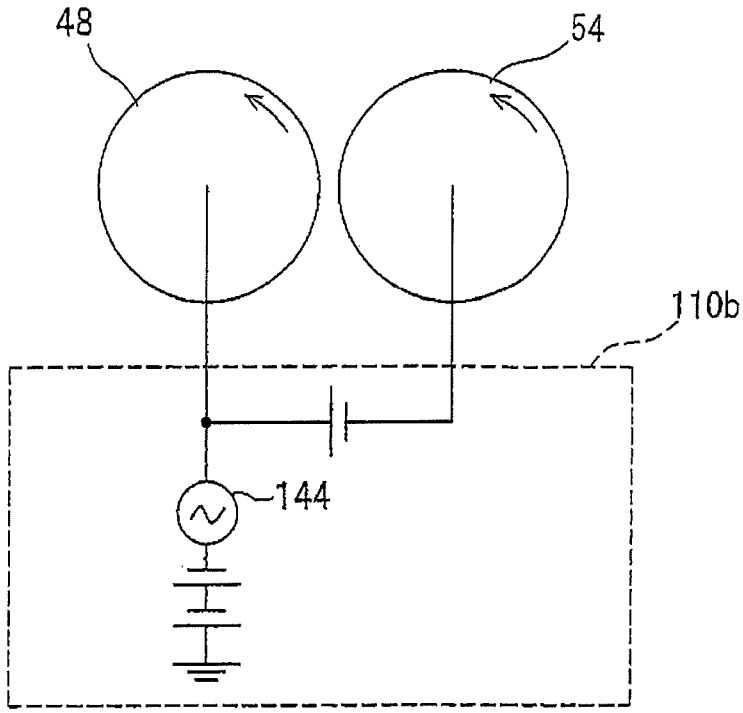
FIG. 11A is a diagram showing one embodiment of a conventional electric-field-forming device.
Figure 11B:
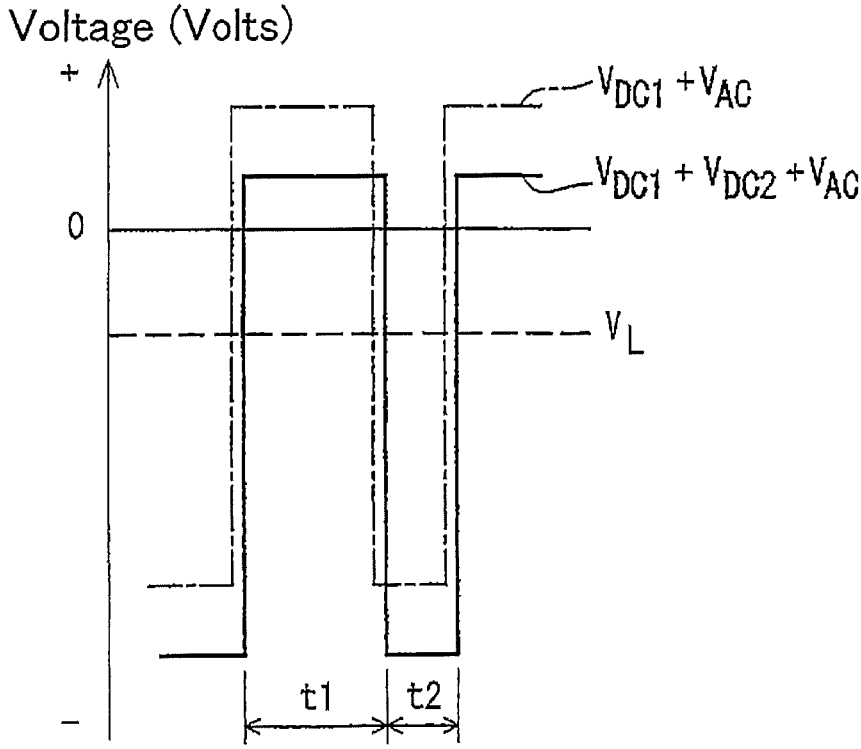
FIG. 11B is a diagram showing a relationship between voltages supplied to the developing roller and the transporting roller from the electric-field-forming device shown in FIG. 11A.

An electric-field forming device 110*b* shown in FIG. 5 is provided with a first power supply 112 connected to the developing roller 48 and a second power supply 114 connected to the transporting roller 54. The first power supply 112 has a dc power supply 118 and an ac power supply 154 that are connected between the developing roller 48 and a ground 116. The dc power supply 118 applies a first dc voltage $V_{DC1}$ (for example, −200 volts) having the same polarity as the charged polarity of the toner 6 to the developing roller 48. The ac power supply 154 applies an ac voltage $V_{AC1}$ having a peak-to-peak voltage $V_{P-P}$ of, for example, 300 volts between the developing roller 48 and the ground 116. The second power supply 114 is provided with a dc power supply 120 and an ac power supply 156 connected between the transporting roller 54 and the ground 116. The dc power supply 120 applies a second dc voltage $V_{DC2}$ (for example, −400 volts) having the same polarity as the charged polarity of the toner 6 and a higher voltage than the first dc voltage to the transporting roller 54. The ac power supply 156 applies an ac voltage $V_{AC2}$ having a peak-to-peak voltage $V_{P-P}$ of, for example, 300 volts between the transporting roller 54 and the ground 116. The ac voltages $V_{AC1}$ and $V_{AC2}$ have respectively inverted phases so as to form an ac electric field having a large amplitude between the developing roller and the transporting roller. As a result, in the same manner as in FIG. 4A, in the supply area 90, the toner 6 is electrically attracted from the carrier 4 on the surface of the transporting roller 54 to the developing roller 48 effectively, by the function of a pulsating current electric field, and in the recovery area 92, residual toner is electrically attracted from the developing roller 48 to the carrier 4 on the surface of the transporting roller 54 effectively, by the function of the pulsating current electric field. In the developing area 96, the negative polarity toner, held on the developing roller 48, is allowed to adhere to the electrostatic latent image portion based upon the electric potential difference between the developing roller 48 ($V_{DC1}$: −200 volts) and the electrostatic latent image portion ($V_L$: −80 volts) and the pulsating current electric field achieved by the ac power supply 154. As one example of a state in which no ac electric field is formed even when the ac voltage is applied, a power supply as shown in FIG. 11A is given. In FIG. 11A, since the ac power supply 144 to be used for the developing roller 48 and the ac power supply 144 to be used for the transporting roller 54 are the same power supply, no ac electric field is formed therebetween.

Figure 6:
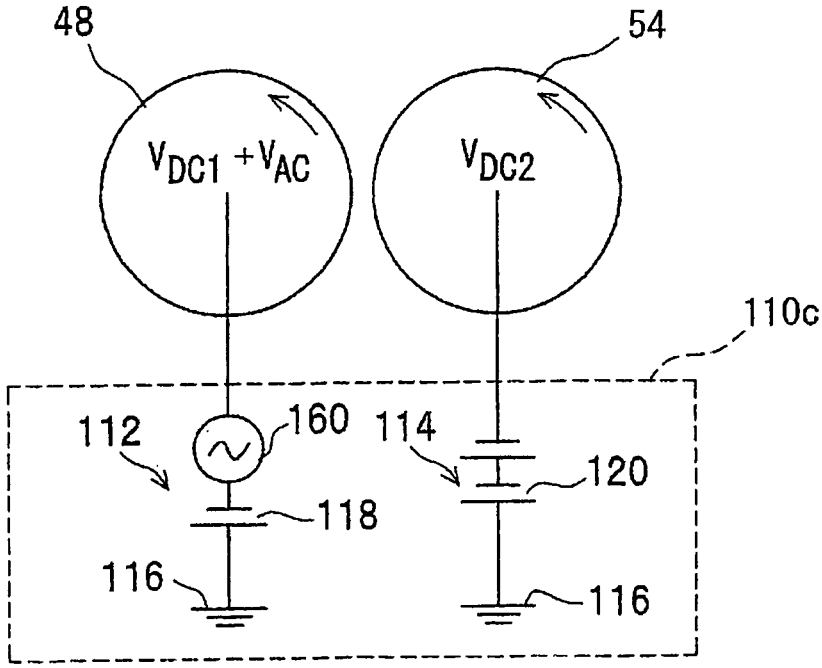
FIG. 6 is a diagram showing another embodiment of the electric-field-forming device.

An electric-field forming device 110*c* shown in FIG. 6 is provided with a first power supply 112 connected to the developing roller 48 and a second power supply 114 connected to the transporting roller 54. The first power supply 112 has a dc power supply 118 and an ac power supply 160 that are connected between the developing roller 48 and the ground 116. The dc power supply 118 applies a first dc voltage $V_{DC1}$ (for example, −200 volts) having the same polarity as the charged polarity of the toner 6 to the developing roller 48. The ac power supply 160 applies an ac voltage $V_{AC1}$ having a peak-to-peak voltage $V_{P-P}$ of, for example, 300 volts between the developing roller 48 and the ground 116. The second power supply 114 is provided with a dc power supply 120 connected between the transporting roller 54 and the ground 116. The dc power supply 120 applies a second dc voltage $V_{DC2}$ (for example, −400 volts) having the same polarity as the charged polarity of the toner 6 and a higher voltage than the first dc voltage to the transporting roller 54. As a result, in the same manner as in FIG. 4A, in the supply area 90, the toner 6 is electrically attracted from the carrier 4 on the surface of the transporting roller 54 to the developing roller 48 effectively by the function of the pulsating current electric field, and in the recovery area 92, residual toner is electrically attracted from the developing roller 48 onto the carrier 4 on the surface of the transporting roller 54 effectively by the function of the pulsating current electric field. In the developing area 96, the negative polarity toner, held on the developing roller 48, is allowed to adhere to the electrostatic latent image portion based upon the electric potential difference between the developing roller 48 ($V_{DC1}$: −200 volts) and the electrostatic latent image portion ($V_L$: −80 volts) and the pulsating current electric field achieved by the ac power supply 160.

Developer

The developer to be used in the present invention is a two-component developing agent mainly composed of a toner and a carrier, more preferably, further including charged-particles (implanted particles) to be charged to the polarity reversed to that of the toner as a third component. Even when stain (spent) is caused on the surface of carrier by adhesion of toner thereto, the charged-particles are allowed to adhere to the spent portion so that the life of carrier can be prolonged.

The charged-particles to be desirably used are selected on demand depending on the charging polarity of toner so that those particles to be charged to the polarity reversed to the charging polarity of toner upon frictional contact with toner are used, and normally, those particles to be charged to the polarity reversed to the charging polarity of toner upon frictional contact with carrier are used. The average primary particle size of the charged-particles is, for example, 100 to 1000 nm. More specifically, for example, in the case when the toner to be charged to negative polarity upon frictional contact with carrier is used, those particles to be charged to positive polarity upon contact with the toner are used as charged-particles, and normally those particles to be charged to positive polarity upon frictional contact with the carrier are used. Those particles are made from, for example, inorganic particles, such as strontium titanate, barium titanate, magnesium titanate, calcium titanate and alumina, and a thermoplastic resin or a thermosetting resin, such as acrylic resin, benzoguanamine resin, nylon resin, polyimide resin and polyamide resin. To the resin forming the charged-particles, a positive-charge controlling agent that is charged to positive polarity upon contact with the toner may be added. As a positive-charge controlling agent, for example, Nigrosine dye, a quaternary ammonium salt or the like may be used. The charged-particles may be made from a nitrogen-containing monomer. Examples of the material for forming a nitrogen-containing monomer include: 2-dimethylaminoethyl acrylate, 2-diethylaminoethyl acrylate, 2-dimethylaminoethyl methacrylate, 2-diethylaminoethyl methacrylate, vinyl pyridine, N-vinyl carbazole and vinyl imidazole. Preferable combinations of the binder resin forming the negatively chargeable toner and the material forming the positively chargeable charged-particles are described as follows:

(Negatively chargeable toner-Positively chargeable charged-particle)

Polyester-$SrTiO_3$

Styrene-methacrylate resin-$SrTiO_3$

Polyester-$CaTiO_3$

Styrene-methacrylate resin-$CaTiO_3$

For example, in the case of a toner that is charged to positive polarity upon frictional contact with carrier, those particles to be charged to negative polarity upon contact with the toner are used as charged-particles, and normally those particles to be charged to negative polarity upon frictional contact with the carrier are used. Examples of those particles include: inorganic particles, such as silica and titanium oxide, and particles made from a thermoplastic resin or a thermosetting resin, such as fluororesin, polyolefin resin, silicone resin and polyester resin. To the resin forming the charged-particles, a negative-charge controlling agent that is charged to negative polarity upon contact with the toner may be added. As a negative-charge controlling agent, for example, salicylic acid-based, or naphthol-based chromium complex, aluminum complex, iron complex, or zinc complex may be used. The charged-particles may be made from a copolymer of a fluorine-containing acrylic monomer or a fluorine-containing methacrylic monomer. Preferable combinations of the binder resin forming the positively chargeable toner and the material forming the negatively chargeable charged-particles are described as follows:

(Positively chargeable toner binder resin-Negatively chargeable charged-particle)

Styrene acrylic resin-Silica

Polyaminoacrylate-Polyfluoroacrylic beads

Polyaminoacrylate-PTFE beads

Styrene acrylic resin-Polyfluoroacrylic beads

Styrene acrylic resin-PTFE beads

In order to control chargeability and hydrophobicity of the charged-particles, the surface of inorganic particle may be surface-treated by using a silane coupling agent, a titanium coupling agent, silicone oil, or the like. In particular, when positive chargeability is imparted to the inorganic particles, it is preferable to use an amino-group-containing coupling agent for the surface-treating process. When negative-polarity chargeability is imparted to the particles, it is preferable to use a fluorine-group-containing coupling agent for the surface-treating process.

Although not particularly limited as long as the object of the present invention is achieved, the content of charged-particles is preferably set in a range from 0.1 to 5.0% by weight, in particular, from 0.5 to 3.0% by weight with respect to the toner.

Conventionally known toners generally used in image-forming apparatuses may be used as a toner. The particle size of toner is, for example, set to about 3 to 15 μm, preferably to 4.5 to 7 μm. Even when a toner having a comparatively small particle size is used, the effects of the present invention can be efficiently obtained.

The toner is formed by adding external additives to toner particles containing at least a colorant in a binder resin. A charge-controlling agent and/or a releasing agent may be further contained in the toner particles. The toner particles may be produced by using a known method such as a pulverizing method, an emulsion polymerization method or a suspension polymerization method.

Although not particularly limited, examples of binder resins to be used for toner include: styrene-based resins (homopolymer or copolymer containing styrene or styrene substitute), polyester resins, epoxy-based resins, vinyl chloride resins, phenolic resins, polyethylene resins, polypropylene resins, polyurethane resins, silicone resins, styrene acrylic resins, nitrogen-containing acrylic resins, or resins formed by desirably mixing these resins. It is preferable that the binder resin has a softening temperature in a range of about 80 to 160° C., with a glass transition point in a range of about 50 to 75° C.

The colorant may be used from known materials, and examples thereof include: carbon black, aniline black, activated carbon, magnetite, Benzene Yellow, Permanent Yellow, Naphthol Yellow, Phthalocyanine Blue, Fast Sky Blue, Ultramarine Blue, Rose Bengal and Lake Red. In general, the addition amount of colorant is set in a range from 2 to 20 parts by weight relative to 100 parts by weight of binder resin.

Those materials conventionally known as charge-controlling agents may be used as a charge-controlling agent. Examples of the charge-controlling agent used for the positively chargeable toner include: Nigrosine dyes, quaternary ammonium salt-based compounds, triphenylmethane-based compounds, imidazole-based compounds and polyamine resins. Examples of the charge-controlling agent used for the negatively chargeable toner include: metal-containing azo-based dyes of Cr, Co, Al, Fe, salicylic acid metal compounds, alkyl salicylic acid metal compounds, and calix arene-based compounds. The charge-controlling agent is preferably used at a rate of 0.1 to 10 parts by weight relative to 100 parts by weight of binder resin.

Those materials conventionally known as releasing agents may be used as a releasing agent. Examples of materials used for the releasing agent include polyethylene, polypropylene, carnauba wax, sazol wax, or a mixture prepared by combining these on demand. The releasing agent is preferably used at a range of 0.1 to 10 parts by weight relative to 100 parts by weight of binder resin.

Examples of materials for the external additives include: inorganic fine particles of silica, titanium oxide, aluminum oxide or the like, and resin fine particles of acrylic resin, styrene resin, silicone resin, fluorine resin or the like. In particular, those materials that have been subjected to a hydrophobicity-applying treatment by using a silane coupling agent, a titanium coupling agent or silicone oil may be preferably used. The external additive is preferably added at a rate of 0.1 to 5 parts by weight relative to 100 parts by weight of toner particles. The number-average primary particle size of external additive is preferably set in a range from 9 to 100 nm, more preferably from 9 to less than 100 nm.

Those known carriers, generally used conventionally, may be used as a carrier. For example, either of a binder-type carrier and a coat-type carrier may be used. Not particularly limited, the particle size of carrier is preferably set in a range of about 15 to 100 μm.

The binder-type carrier, which is formed by dispersing magnetic fine particles in a binder resin, may be provided with, on demand, positively chargeable or negatively chargeable fine particles applied onto its surface or a coating layer formed thereon. The charging characteristics, such as polarity of the binder-type carrier, can be controlled by the material of binder resin, the chargeable fine particles and the kinds of surface coating layer.

Examples of the binder resin used for the binder-type carrier include vinyl-based resins, typically exemplified by polystyrene-based resins, polyacrylic resins and styrene-methacrylate copolymers, thermoplastic resins, such as polyester-based resins, nylon-based resins and polyolefin resins, and thermosetting resins, such as phenolic resins.

Examples of the magnetic fine particles used for the binder-type carrier include: magnetite, spinel ferrites such as gamma iron oxide, spinel ferrites containing one kind or two or more kinds of metals (Mn, Ni, Mg, Cu and the like) other than iron, magnetoplumbite-type ferrites such as barium ferrite, and particles of iron or an alloy having an oxide layer on the surface thereof. The shape of the carrier may be formed into any of a particle shape, a spherical shape and a needle shape. In particular, when high magnetization is required, iron-based ferromagnetic fine particles may be preferably used. From the viewpoint of chemical stability, ferromagnetic fine particles of spinel ferrite including magnetite, gamma iron oxide or the like, and magnetoplumbite-type ferrite such as barium ferrite are preferably used. By properly selecting the kind and content of the ferromagnetic fine particles on demand, a magnetic resin carrier having a desired magnetization can be obtained. The magnetic fine particles are preferably added to the magnetic resin carrier at a rate in a range from 50 to 90% by weight.

Examples of a surface-coating material for the binder-type carrier include silicone resin, acrylic resin, epoxy resin and fluorine-based resin. By coating the carrier surface with any one of these resins to be hardened so that a coat layer is formed thereon, the charge-applying capability of the carrier can be improved.

The anchoring of the chargeable fine particles or conductive fine particles onto the surface of binder-type carrier is carried out through, for example, processes in which the magnetic resin carrier and the fine particles are uniformly mixed so that the fine particles are allowed to adhere to the surface of magnetic resin carrier, and the fine particles are then injected to the magnetic resin carrier by applying a mechanical/thermal impact thereto. In this case, the fine particles are not embedded into the magnetic resin carrier completely, but fixed thereto, with one portion thereof partially protruding from the surface of magnetic resin carrier. An organic or inorganic insulating material is used as chargeable fine particles. More specifically, examples of the organic insulating material include organic insulating fine particles of polystyrene, styrene-based copolymer, acrylic resin, various acrylic copolymers, nylon, polyethylene, polypropylene, fluorine resin, or crosslinked products thereof. The charge-applying capability and the charging polarity can be adjusted by the material, polymerizing catalyst, surface treatment and the like of the chargeable fine particles. Examples of the inorganic insulating material include inorganic fine particles that are charged to negative polarity, such as silica and titanium dioxide, and inorganic fine particles that are charged to positive polarity such as strontium titanate and alumina.

The coat-type carrier is a carrier formed by coating a carrier core particle made of a magnetic material with a resin, and in the same manner as in the binder-type carrier, chargeable fine particles that charge the carrier surface to positive polarity or negative polarity can be anchored thereon. The chargeable characteristics, such as polarity, of the coat-type carrier can be adjusted by selecting the kind of the surface coating layer and the chargeable fine particles. The same resin as the binder resin of the binder-type carrier can be applied to the coating resin.

The mixed ratio of toner and carrier is desirably adjusted so that a desired quantity of charge of toner is obtained, and the toner ratio is preferably set to 3 to 50% by weight, more preferably to 6 to 30% by weight relative to the sum of toner and carrier.

EXAMPLES

Toner A

To 100 parts by weight of toner particles having a volume average particle size of 6.5 μm, produced by a wet granulation method, were externally added 0.2 parts by weight of first hydrophobic silica, 0.5 parts by weight of second hydrophobic silica, 0.5 parts by weight of hydrophobic titanium oxide and 2 parts by weight of strontium titanate that had a number-average particle size of 350 nm, serving as reverse polarity particles, by the use of Henschel mixer (made by Mitsui Mining & Smelting Co., Ltd.), so that a negatively chargeable toner was obtained. A styrene-acrylic resin was used as a binder resin.

The first hydrophobic silica used in this case was silica having a number-average primary particle size of 16 nm (#130: made by Nippon Aerosil Co., Ltd.), which had been subjected to a surface treatment by hexamethyldisilazane (HMDS) serving as a hydrophobizing agent.

The second hydrophobic silica was silica having a number-average primary particle size of 20 nm (#90: made by Nippon Aerosil Co., Ltd.), which had been subjected to a surface treatment by HMDS.

The hydrophobic titanium was obtained by subjecting anatase-type titanium oxide having a number-average primary particle size of 30 nm to a surface treatment by using isobutyltrimethoxysilane serving as a hydrophobizing agent in an aqueous wet system.

Toner B

To 100 parts by weight of toner particles having a volume average particle size of 5 μm, produced by a wet granulation method, were externally added 0.3 parts by weight of a first hydrophobic silica, 0.75 parts by weight of a second hydrophobic silica, 0.75 parts by weight of hydrophobic titanium oxide and 3 parts by weight of strontium titanate that had a number-average particle size of 350 nm, serving as reverse polarity particles, by the use of Henschel mixer (made by Mitsui Mining & Smelting Co., Ltd.), so that a negatively chargeable toner was obtained. A styrene-acrylic resin was used as a binder resin.

The first hydrophobic silica, the second hydrophobic silica and the hydrophobic titanium oxide are the same as those used in toner A.

Carrier

A coat-type carrier, formed by coating a carrier core particle made of a magnetic material with an acrylic resin, having an average particle size of about 25 μm, was used.

Developer

Toner A or toner B was mixed with the carrier so that a developer was obtained. The toner density in the developer was 8 wt % in (toner weight)/(developer weight).

Developing Roller A1

Figure 10:
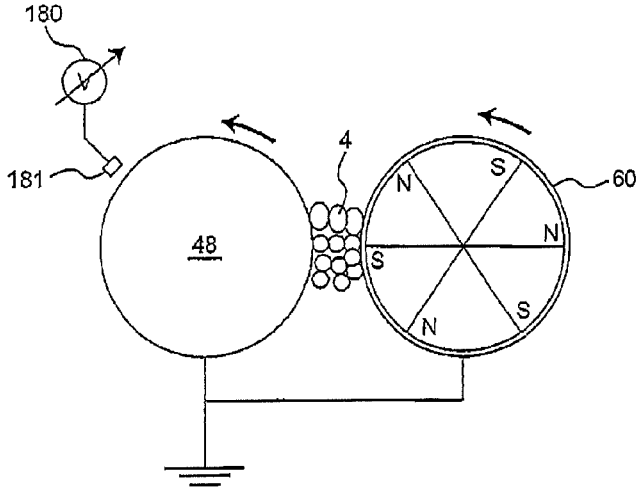
FIG. 10 is a schematic view for illustrating a method for detecting a charging polarity of the surface of developing roller.

A fluorine-atom-containing polymer (fluoridated polymethacrylate) was dissolved in methylethyl ketone, and carbon black was dispersed in the resulting solution so that a coating solution was obtained. This coating solution was applied by a dipping method onto an aluminum pipe to be used for a developing roller, and dried so that a coating film having a thickness of 10 μm was formed. The resistivity of the developing roller was $5\times10^3\Omega$ when measured by HIRESTA® made by Mitsubishi Chemical Corp. The charging polarity of the surface of the developing roller was measured as follows: as shown in FIG. 10, a rotating sleeve 60 bearing the carrier 4 was made in contact with a developing roller 48 that was rotating at a peripheral speed slower than that of the sleeve 60 in the same direction as the sleeve 60, and after having rotated once, the surface potential was measured and detected by using a surface electrometer 180 with a probe 181. The surface potential of the present developing roller was −5 V, and the surface of the developing roller was found to be negatively chargeable relative to the carrier. The measuring methods for the resistivity, the surface potential and thickness of the following developing rollers are the same as those methods used in developing roller A1.

Developing Roller A2

The same method as that of developing roller A1 was carried out except that the added amount of carbon black was reduced so that a developing roller A2 was produced. The resistivity of this developing roller was $5\times10^5\Omega$, and the surface potential thereof was −10 V, and the surface of the present developing roller was found to be negatively chargeable relative to the carrier.

Developing Roller A3

The same method as that of developing roller A1 was carried out except that the added amount of carbon black was further reduced so that a developing roller A3 was produced. The resistivity of this developing roller was $5\times10^8\Omega$, with the surface potential thereof being set to −25 V, and the surface of the present developing roller was found to be negatively chargeable relative to the carrier.

Developing Rollers A4 to A6

The same methods as those of developing rollers A1 to A3 were carried out except that magnets were internally installed so that developing rollers A4 to A6 were produced. Each magnet, which had a magnetic flux density of 500 mT, and also had a magnetic polarity reversed to that of the magnetic pole of the portion inside the transporting roller 54 opposing to the developing roller 48, was fixedly disposed at a portion opposing to the transporting roller 54, as shown in FIG. 7.

Developing Roller B1

The aluminum pipe was used as it was as a developing roller B1. The resistivity of the present developing roller was 0Ω.

Developing Roller B2

The same method as that of developing roller A1 was carried out except that the added amount of carbon black was increased in comparison with that of developing roller A1 so that a developing roller B2 was produced. The resistivity of this developing roller was $5\times10^{2}\Omega$, with the surface potential thereof being set to 0 V, and there was hardly any exchange of charges due to friction.

Developing Roller B3

The same method as that of developing roller A1 was carried out except that no carbon black was added to the coating solution so that a developing roller B3 was produced. The resistivity of this developing roller was $5\times10^{9}\Omega$, with the surface potential thereof being set to −40 V, and the surface of the present developing roller was found to be negatively chargeable relative to the carrier.

Developing Roller B4

The roller surface of developing roller A1 was subjected to an alumite treatment. The resistivity of this developing roller was $5\times10^{13}\Omega$, with the surface potential thereof being set to 0 V, and there was hardly any exchange of charges due to friction.

Developing Roller B5

The same method as that of developing roller A1 was carried out except that, in place of the fluorine-atom-containing polymer, a polyamide-based resin was used and that the added amount of carbon black was changed, so that a developing roller B5 was produced. The resistivity of this developing roller was $5\times10^{5}\Omega$, with the surface potential thereof being set to +20 V, and the surface of the present developing roller was found to be positively chargeable relative to the carrier.

Developing Rollers B6 and B7

The same methods as those of developing rollers B2 and B3 were carried out except that magnets were internally installed so that developing rollers B6 and B7 were produced. Each magnet, which had a magnetic flux density of 500 mT, and also had a magnetic polarity reversed to that of the magnetic pole of the portion inside the transporting roller 54 opposing to the developing roller 48, was fixedly disposed at a portion opposing to the transporting roller 54, as shown in FIG. 7.

Experimental Example 1

A developer using toner A or toner B and a developing roller described in Table 1 or Table 2 were installed into such an image-forming apparatus as shown in FIG. 1. By using this image-forming apparatus, 200,000 sheets of a sample image having a rate of printed portion of 5% within the area of output paper were printed under the following conditions.

Figure 8:
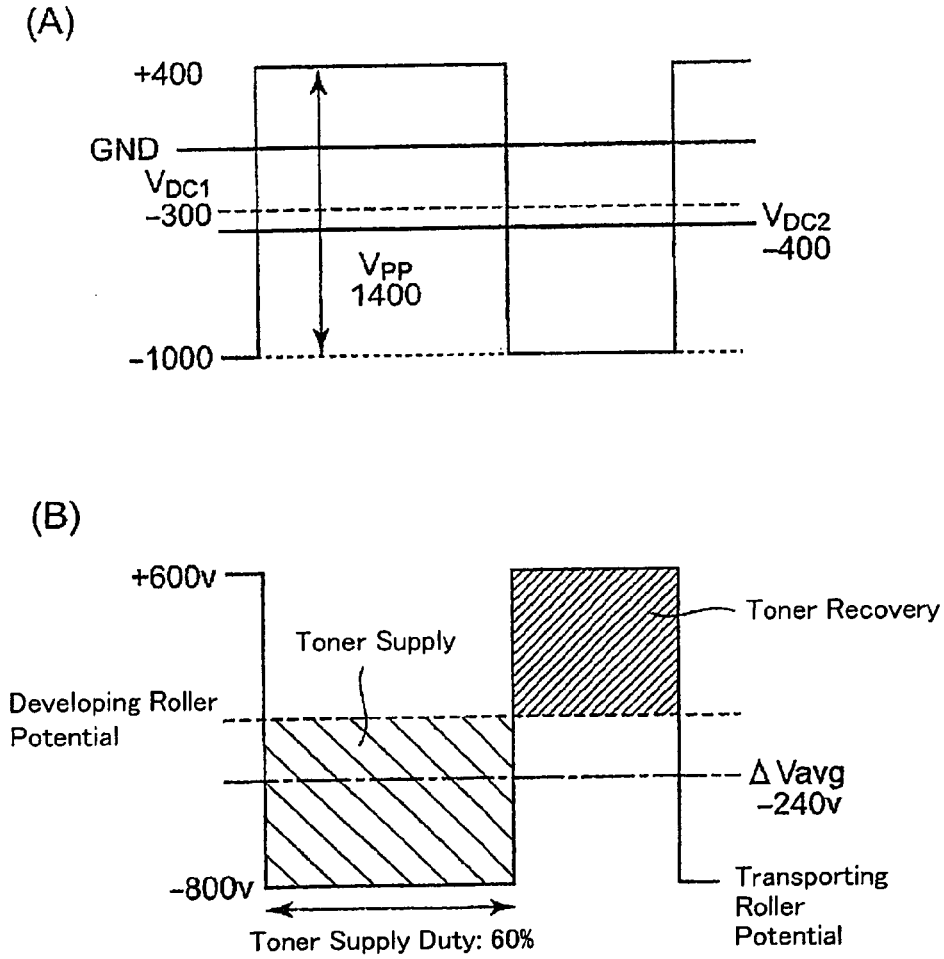
FIG. 8(A) is a schematic diagram showing bias conditions relative to the developing roller and the transporting roller adopted in an example.
FIG. 8(B) is a schematic diagram showing an electric potential of the transporting roller relative to the electric potential of the developing roller under bias conditions shown in FIG. 8(A).

The developing conditions were as follows: An electric-field forming device having a mode shown in FIG. 6 was used, a dc voltage $V_{DC2}$: −400 volts was applied to the transporting roller, and a dc voltage $V_{DC1}$: −300 volts and an ac voltage were applied to the developing roller. The ac voltage had a rectangular wave having a frequency: 3 kHz, an amplitude $V_{P\text{-}P}$: 1,400 volts, a minus duty ratio (toner recovery duty ratio): 40% and a plus duty ratio (toner supply duty ratio): 60%. FIG. 8(A) shows these bias conditions. FIG. 8(B) shows an electric potential of the transporting roller relative to the electric potential of the developing roller. The developing gap 50 was set to 0.15 mm, the supply/recovery gap 56 was set to 0.3 mm, and the regulating gap 64 was set to 0.5 mm. The amount of transported developer onto the transporting roller was 250 g/m$^2$. The charged potential (non-image portion) of the photosensitive member was −550 volts, and the electric potential (image portion) of an electrostatic latent image formed on the photosensitive member was −50 volts.

Evaluation

The 10,000$^{th}$ printed image was evaluated on its image memory and image density. The amount of transferred toner onto the developing roller at the time of the 100$^{th}$ printing operation was measured.

Image Memory

An image pattern having a half tone portion following a solid portion was outputted, and determination was made based upon a difference ΔTD of the measured results of transmission density by a densitometer made by Macbeth Process Measurements Co. between a memory generation portion and the peripheral portion in the half tone image and visual observations, and evaluation was made.

⊙; No image memory occurred (ΔTD=0);

○; Hardly any image memory was detected by the visual observation, and no problems were raised in practical use (0<ΔTD≦0.05);

x; Image memory was visually observed, and in this level, problems were raised in practical use (ΔTD>0.05).

Image Density

The image density was measured by using a densitometer made by Macbeth Process Measurements Co.

○; TD>1.1;

Δ; 1.1>TD≦1;

x; TD<1.

Toner Transport Amount

The amount of toner transport onto the developing roller required for obtaining target image density and image quality was 4 g/m$^2$.

TABLE 1

| | Toner A | | | Toner B | | |
|---|---|---|---|---|---|---|
| Developing Roller No. | Image memory | Toner transport amount | Image density | Image memory | Toner transport amount | Image density |
| B1 | X | 5.3 | ○ | X | 4.7 | ○ |
| B2 | X | 5 | ○ | X | 4.5 | ○ |
| A1 | ○ | 5 | ○ | ○ | 4.5 | ○ |
| A2 | ○ | 5 | ○ | ○ | 4.4 | ○ |
| A3 | ○ | 5.1 | ○ | ○ | 4.4 | ○ |
| B3 | ○ | 3.2 | X | ○ | 2.5 | X |
| B4 | ○ | 1.4 | X | ○ | 1.1 | X |
| B5 | X | 5 | X | X | 4 | X |

TABLE 2

| | Toner B | | |
|---|---|---|---|
| Developing Roller No. | Image memory | Toner transport amount | Image density |
| B6 | X | 4.8 | ○ |
| A4 | ⊙ | 4.7 | ○ |

TABLE 2-continued

| Developing Roller No. | Toner B Image memory | Toner transport amount | Image density |
|---|---|---|---|
| A5 | ⊙ | 5 | ○ |
| A6 | ⊙ | 5.1 | ○ |
| B7 | ○ | 3 | X |

Experimental Example 2

The evaluation was made in a manner similar to experimental example 1, except that developing rollers shown in Table 3 were used and that the developing conditions were set as follows.

Figure 9:
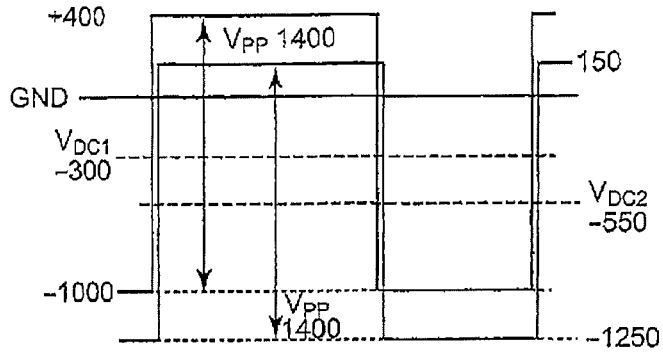
FIG. 9(A) is a schematic diagram showing bias conditions relative to the developing roller and the transporting roller adopted in a comparative example.
FIG. 9(B) is a schematic diagram showing an electric potential of the transporting roller relative to the electric potential of the developing roller under bias conditions shown in FIG. 9(A).
Figure 9:
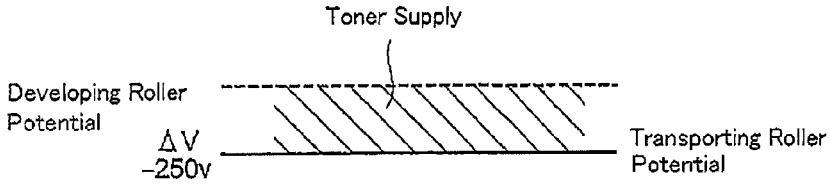

The developing conditions are described as follows: An electric-field forming device having a mode shown in FIG. 11A was used. FIG. 9(A) shows specific bias conditions. FIG. 9(B) shows an electric potential of the transporting roller relative to the electric potential of the developing roller. In FIG. 9(A), a dc voltage $V_{DC2}$: −550 volts and an ac voltage were applied to the transporting roller. The ac voltage had a rectangular wave having a frequency: 3 kHz, an amplitude $V_{P-P}$: 1,400 volts, a minus duty ratio t2: 40% and a plus duty ratio t1: 60%. A dc voltage $V_{DC1}$: −300 volts and an ac voltage were applied to the developing roller. The ac voltage had a rectangular wave having a frequency: 3 kHz, an amplitude $V_{P-P}$: 1,400 volts, a minus duty ratio (toner recovery duty ratio):40% and a plus duty ratio (toner supply duty ratio): 60%. The other conditions were the same as those of experimental example 1.

TABLE 3

| Developing Roller No. | Toner B Image memory | Toner transport amount | Image density |
|---|---|---|---|
| B2 | X | 4.2 | ○ |
| A1 | X | 4.3 | ○ |
| A2 | X | 4.3 | ○ |
| A3 | X | 4.5 | ○ |
| B3 | ○ | 3.7 | X |

What is claimed is:

1. A developing device, which visualizes an electrostatic latent image on an electrostatic latent image-supporting member by using a developer containing a toner and a carrier, comprising:

a developer that contains a toner and a carrier so that the toner is charged to a first polarity, while the carrier is charged to a second polarity that is different from the first polarity, by mutual frictional contact between the toner and the carrier;

a first transporting member placed at an opening portion of a developer vessel used for housing the developer;

a second transporting member that faces the first transporting member with a first area interposed therebetween, and also faces an electrostatic latent image-supporting member with a second area interposed therebetween;

a first electric-field-forming unit used for forming a first electric field between the first transporting member and the second transporting member so that the toner in the developer held by the first transporting member is transferred onto the second transporting member; and a second electric-field-forming unit used for forming a second electric field between the second transporting member and the electrostatic latent image-supporting member so that the toner held by the second transporting member is transferred onto the electrostatic latent image on the electrostatic latent image-supporting member to visualize the electrostatic latent image, wherein the first electric field, formed between the first transporting member and the second transporting member, includes at least an ac electric field, and the second transporting member has a surface that is charged to the same polarity as the charged polarity of the toner by friction-contact with the carrier, and a volume resistance value of $1\times10^3$ to $1\times10^9$ (Ω).

2. The developing device of claim 1, wherein at an opposing portion to the first transporting member inside the second transporting member, a magnet, which has a magnetic pole different from a magnetic pole placed at an opposing portion to the second transporting member inside the first transporting member, is placed.

3. The developing device of claim 1, wherein the second transporting member has a surface layer having a thickness in a range from 10 to 50 μm.

4. The developing device of claim 1, wherein the toner is charged to negative polarity by frictional contact with the carrier and the second transporting member has a negatively chargeable organic surface layer.

5. The developing device of claim 1, wherein a binder resin of the toner is a styrene acrylic resin, a resin forming a surface of the second transporting member is a fluorine resin and a resin forming the carrier is an acrylic resin.

6. The developing device of claim 1, wherein the toner is charged to positive polarity by frictional contact with the carrier and the second transporting member has a positively chargeable organic surface layer.

7. The developing device of claim 1, wherein a binder resin of the toner is a styrene acrylic resin, a resin forming a surface of the second transporting member is a polyamide resin and a resin forming the carrier is an acrylic resin.

8. An image-forming apparatus, comprising an electrostatic latent image-supporting member in which an electrostacic latent image is formed thereon, and a developing device for visualizing the electrostatic latent image by using a developer containing a toner and a carrier, wherein the developing device comprises:

a developer that contains a toner and a carrier so that the toner is charged to a first polarity, while the carrier is charged to a second polarity that is different from the first polarity, by mutual frictional contact between the toner and the carrier;

a first transporting member placed at an opening portion of a developer vessel used for housing the developer;

a second transporting member that faces the first transporting member with a first area interposed therebetween, and also faces an electrostatic latent image-supporting member with a second area interposed therebetween;

a first electric-field-forming unit used for forming a first electric field between the first transporting member and the second transporting member so that the toner in the developer held by the first transporting member is transferred onto the second transporting member; and a second electric-field-forming unit used for forming a second electric field between the second transporting member and the electrostatic latent image-supporting member so that the toner held by the second transporting member is transferred onto the electrostatic latent image on the electrostatic latent image-supporting member to visualize the electrostatic latent image, wherein the first electric field, formed between the first transporting member and the second transporting member, includes at least an ac electric field, and the second transporting member has a surface that is charged to the same polarity as the charged polarity of the toner by friction-contact with the carrier, and a volume resistance value of $1\times10^3$ to $1\times10^9$ (Ω).

9. The image-forming apparatus of claim 8, wherein at an opposing portion to the first transporting member inside the second transporting member, a magnet, which has a magnetic pole different from a magnetic pole placed at an opposing portion to the second transporting member inside the first transporting member, is placed.

10. The image-forming apparatus of claim 8, wherein the second transporting member has a surface layer having a thickness in the range from 10 to 50 μm.

11. The image-forming apparatus of claim 8, wherein the toner is charged to negative polarity by frictional contact with the carrier and the second transporting layer has a negatively chargeable organic surface layer.

12. The image-forming apparatus of claim 8, wherein a binder resin of the toner is a styrene acrylic resin, a resin forming a surface of the second transporting member is a fluorine resin and a resin forming the carrier is an acrylic resin.

13. The image-forming apparatus of claim 8, wherein the toner is charged to positive polarity by frictional contact with the carrier and the second transporting member has a positively chargeable organic surface layer.

14. The image-forming apparatus of claim 8, wherein a binder resin of the toner is a styrene acrylic resin, a resin forming a surface of the second transporting member is a polyamide resin and a resin forming the carrier is an acrylic resin.

* * * * *